US010113282B2

(12) United States Patent
Behan et al.

(10) Patent No.: US 10,113,282 B2
(45) Date of Patent: Oct. 30, 2018

(54) CUTTING EDGE ATTACHMENT FOR SNOW PLOW

(71) Applicants: Richard Anthony Behan, West Chicago, IL (US); Paulette Sanders Behan, West Chicago, IL (US)

(72) Inventors: Richard Anthony Behan, West Chicago, IL (US); Paulette Sanders Behan, West Chicago, IL (US)

(73) Assignee: Nordic Auto Plow LLC, West Chicago, IL (US)

( * ) Notice: Subject to any disclaimer, the term of this patent is extended or adjusted under 35 U.S.C. 154(b) by 404 days.

(21) Appl. No.: 14/530,924

(22) Filed: Nov. 3, 2014

(65) Prior Publication Data

US 2016/0122959 A1 May 5, 2016

(51) Int. Cl.
*E01H 5/06* (2006.01)

(52) U.S. Cl.
CPC ..... *E01H 5/061* (2013.01)

(58) Field of Classification Search
CPC ..... E01H 5/06–5/066; E02F 3/8157; E02F 3/8152; E02F 3/815; E02F 3/972
See application file for complete search history.

(56) References Cited

U.S. PATENT DOCUMENTS 1,424,750 A * 8/1922 Anglemeyer et al. E02F 9/2825 37/455
1,543,222 A * 6/1925 McVeety ..... E02F 3/8152 172/701.3
1,633,057 A * 6/1927 Wold ..... E02F 3/8152 172/701.3
1,744,139 A * 1/1930 Patton ..... E02F 3/815 172/701.3
1,871,565 A * 8/1932 Soule ..... E01H 5/061 37/272
1,920,475 A * 8/1933 Meyer ..... E01H 5/06 37/231
1,925,397 A * 9/1933 Meyer ..... E01H 5/062 172/387
1,944,307 A * 1/1934 Spoon ..... E02F 3/8152 172/251
2,061,585 A * 11/1936 Meyer ..... E01H 1/105 15/245
2,245,545 A 6/1941 Miller et al.
2,285,039 A * 6/1942 Lowe ..... E02F 3/8152 172/701.3
2,498,470 A * 2/1950 Wenner ..... E01H 5/02 294/59
3,400,475 A 9/1968 Peitl
(Continued)

*Primary Examiner* — Jessica H Lutz
(74) *Attorney, Agent, or Firm* — Vedder Price P.C.

(57) ABSTRACT

The present invention relates to a rounded edge "cutting edge" blade that attaches either directly to the bottom of a plow blade mold board or that attaches to the front side of a traditional cutting edge blade that is already mounted to the mold board using the existing mounting bolts and holes already present. The rounded edge of the blade, when making contact with the ground surface, will not get caught on cracks or irregular surfaces. The rounded edge can be made of steel, polyurethane, rubber or other appropriate composite material and the thickness can vary depending upon the blade and vehicle being mounted to.

3 Claims, 2 Drawing Sheets

(56) References Cited

U.S. PATENT DOCUMENTS 3,934,654 A * 1/1976 Stephenson ..... E01H 5/061 172/701.3
3,995,384 A * 12/1976 Wood ..... E02F 3/8152 172/719
4,346,528 A * 8/1982 Shwayder ..... E01H 5/066 37/270
4,669,205 A 6/1987 Smathers
5,088,215 A * 2/1992 Ciula ..... E01H 5/063 264/279.1
5,140,763 A 8/1992 Nichols, IV
5,224,555 A * 7/1993 Bain ..... E02F 3/8152 172/701.3
5,819,443 A * 10/1998 Winter ..... E01H 1/105 172/766
6,202,327 B1 * 3/2001 Fuller ..... E01H 5/12 37/219
6,240,662 B1 * 6/2001 Borowiak ..... E01H 5/061 37/270
6,922,924 B2 8/2005 Jones et al.
7,631,441 B2 12/2009 Hunt
7,735,247 B2 * 6/2010 Schmeichel ..... E01H 5/06 172/811
7,874,085 B1 * 1/2011 Winter ..... E01H 5/061 172/701.3
7,905,035 B2 * 3/2011 Thomas ..... E01H 5/061 172/701.3
8,191,287 B2 * 6/2012 Winter ..... E01H 5/061 37/266
8,607,481 B1 * 12/2013 Lukasko ..... E01H 5/066 37/232
9,163,379 B2 * 10/2015 Winter ..... E01H 5/061
9,428,874 B2 * 8/2016 Winter ..... E01H 5/061
2003/0182824 A1 * 10/2003 Coffin ..... E01H 5/066 37/266
2005/0178029 A1 * 8/2005 Wightman ..... E01H 5/061 37/232
2007/0215367 A1 * 9/2007 Smart ..... E02F 3/8152 172/695
2008/0301980 A1 12/2008 Hill, III
2011/0198875 A1 8/2011 Smith
2012/0117831 A1 5/2012 Lathrop et al.
2013/0145658 A1 6/2013 Tordik
2013/0212915 A1 8/2013 Abramczyk et al.

* cited by examiner

FIG. 9A
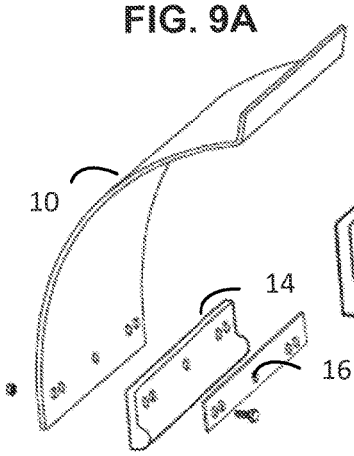
FIG. 9B
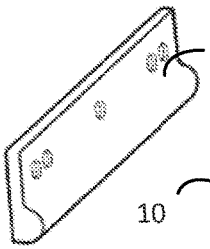
FIG. 10
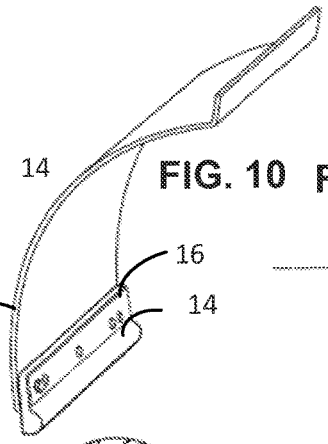
FIG. 12
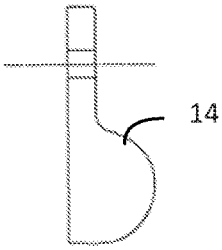
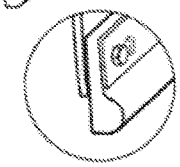
FIG. 11
FIG. 13A
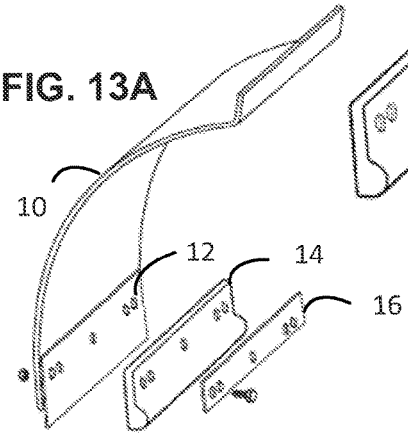
FIG. 13B
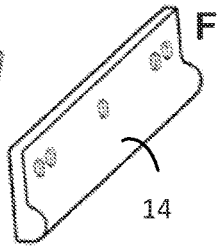
FIG. 14
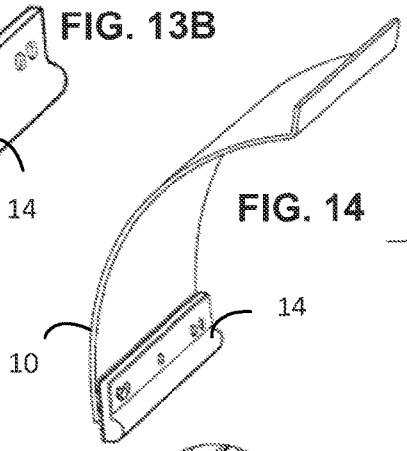
FIG. 16
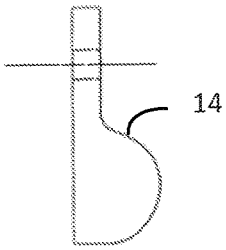
FIG. 15
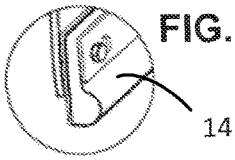

CUTTING EDGE ATTACHMENT FOR SNOW PLOW

BACKGROUND OF THE INVENTION AND PRIOR ART

The present invention relates to a rounded edge "cutting edge" blade that attaches either directly to the bottom of a plow blade mold board or which attaches to the front side of a traditional cutting edge blade that is already mounted to the mold board using the existing mounting bolts and holes. The rounded edge of the blade, when making contact with the ground surface, does not get caught on cracks or irregular surfaces.

Snow plows consist of the main body of a plow, known as a mold board, and replaceable cutting edges that make contact to the ground surface. Cutting edges protect the plow from being dented or bent as it scrapes along irregular ground surface. Once a mold board is bent, it becomes very expensive to repair if repairable at all. Currently cutting edges come in various widths, heights and thicknesses to fit the plow blades on the market ranging from 4 to 12 ft wide, 4 to 10 inches tall, and 0.50 to 3 inches thick, which determines the material they are made from. Cutting edges on the market today are made of polymers, carbon steel, carbide, rubber, polyurethane, or a combination of materials. The rubber or poly composite material edges are molded and have a petroleum base, which makes them more expensive than traditional steel edges. Steel cutting edges can be made of different material, such as carbon steel or carbide, and they come in different gauges and thicknesses as well.

The industry has focused their attention on how to attach the plow to the vehicle, the size of the plow blades, the angle of the plow blade, the hydraulics and mechanics of the mounting system, the control system, and the material the plow blades and cutting edges are made of. Essentially all cutting edges currently in use are made with either a rectangular shape or sharp angle. A rounded edge, when properly constructed and attached to the mold board is superior to the traditional shaped edges because it will bounce over imperfections, and cracks in the surface of roads and will glide over stone, gravel, paver bricks and turf without harming or dislodging the surface. The speed at which the plow is moving, combined with the angle of the blade and weight of the vehicle and plow blade, will generate enough force to remove the material being plowed from the surface with a mold board having a rounded cutting edge. The rounded cutting edge will generate less friction than traditional edges and thus will cause less vibration to the plow blade and vehicle, thus prolonging the life of the equipment. The traditional edges can rip up lane markers, concrete, blacktop, grass, gravel, water main covers, etc. whereas the rounded edge will glide or bounce over them. Potholes and other damage to highways, driveways and paths will be significantly reduced, generating significant savings to municipalities, taxpayers and residences.

The rounded cutting edge of this invention has a cylindrical shape not unlike those set forth in some of the following patent documents, but the particular design of the cylindrical shape, the method of attachment, and the variability of materials are a significant advance in snow plow technology.

U.S. Pat. No. 6,240,662—Borowiak shows mounting brackets welded to a cylinder and attached by bolts passing through holes which must be drilled through the hardened steel of the back of the mold board. It is difficult to drill holes in hardened steel. If a mold board does not have a box design as show in FIG. 2 of Borowiak, the cylinder can not be attached as shown by Borowiak.

U.S. Patent Application Publication No. 2005/0178029—Wightman sets forth a cylinder being attached to the bottom of a traditional cutting edge by pins passing through holes drilled in the cutting edge, which is formed of hardened steel.

The walls of the rounded tube in both the Borowiak patent and the Wrightman published application must be made of steel since round tubes of any polymer, or rubber based composite material would quickly wear or collapse under the weight of the plow. Furthermore, in real life usage, a safety hazard exists in both designs, because once the bottom edge of the cylinder wears through, the front edge of the cylinder will completely dislodge and fall off. When this happens, the strip will ricochet like flying shrapnel that could hit pedestrians, damage vehicles and cause accidents. Further, the arrangements of both Borowiak and Wrightman will lose any advantage a rounded edge affords as soon as the bottom edge wears through, instantly turning the bottom edge of the blade into a vibrating sharp edge with flapping material.

U.S. Pat. No. 8,607,481—Lukasko shows a cylindrical plow blade attachment formed of steel with welded mounting brackets that are attached to the traditional cutting edge using cylindrical fasteners. Holes must be cut into the traditional cutting edge, which can be extremely difficult when the edge is made of hardened steel.

U.S. Pat. No. 8,191,287—Winter et al shows an arrangement for mounting an elastomeric blade edge to a plow mold board.

JP2006233721 (A) shows the use of a rounded edge attached to the bottom of a traditional cutting edge to plow snow. It does not describe an attachment arrangement or the materials to be used.

WO 2013112102 A1—Stalnacke, like the above-mentioned U.S. Pat. No. 8,191,287 sets forth the mounting of an elastomeric blade edge to a plow mold board.

The rounded cutting edge of this invention which is provided by a cylindrically shape member, its method of attachment, and its use of variable materials, which are significant recent advances in snow plow technology, are not disclosed or suggested by the above-mentioned patent documents. The rounded cutting edge of this invention is attached to the mold board by making use of the reinforced holes which are provided in the mold board for attaching cutting edges. It does not require the drilling of holes, or the use of welding. The rounded cutting edge of this invention is attached to the face of an existing cutting edge, or directly to the mold board, while the previous mentioned arrangements require attachment to an existing cutting edge. When the rounded cutting edge of this invention is placed in front of an existing cutting edge, both edges engage the surface being plowed, such that they will wear at the same pace, without the result of any steel being separated from the plow. The rounded cutting edge of this invention will retain its shape and effectiveness throughout the plows usage, which is usually 2 inches of wear like the traditional cutting edges wear.

SUMMARY OF THE INVENTION

This invention relates to a rounded cutting edge that attaches to the mold board of plow blades or to the front of a traditional cutting edge of a mold board. The cutting edge of this invention may be used with a plow pushed by any type of vehicle, such as lawn tractors and mowers, zero turn mowers, utility vehicles, passenger cars, SUV's, pick-up trucks, or any large commercial trucks used by municipalities or contractors. The rounded cutting edge of this invention has a unique design and shape, uses variable production materials and has an attachment method unlike any others. Unlike the prior devices, it is attached to a mold board or cutting edge using provisions of attachment already provided on most mold boards or cutting edges. Thus, it can be use with all mold boards without making any modification to them or existing cutting edges, if attached to the cutting edge. The rounded cutting edge of this invention can be formed of polyurethane, rubber or another solid molded composition material, or can be made of steel.

The rounded cutting edge of this invention, which is readily attachable to existing mold boards, is more efficient and less costly than those set forth in the previously mentioned patent documents. In an embodiment of this invention, the rounded cutting edge is molded to form a solid, one piece section, such that welded mounting brackets are not required. The rounded edge of this invention is made in various thicknesses and sizes, to accommodate the standard plow mold boards now available. The rounded cutting edge is provided in various lengths, widths and thicknesses and bolt hole patterns to accommodate the standard plow mold boards now available. The rounded cutting edge of this invention when formed of composite material and attached directly to a traditional cutting edge, will wear at a much slower pace than other composite material plows now available. A rounded cutting edge of this invention formed of composite material when attached directly to a traditional cutting edge, will wear at a much slower pace than other composite material plows on the market. The rounded cutting edge of this invention when formed of a composite material will wear at the same pace as the steel cutting edge behind it, thus requiring less frequent replacement, saving the user the cost of more frequent replacement and still providing the benefits of less vibration, less road and ground damage, and less wear and tear on the plow blade and vehicle.

BRIEF DESCRIPTION OF THE DRAWINGS

FIG. 9A is a perspective view showing the components of a third embodiment of this invention spaced from a plow mold board:

FIG. 9B is an enlarged perspective view of rounded cutting edge of the first embodiment of this invention when made of polyurethane or other composite material:

FIG. 10 is a perspective view showing the third embodiment of this invention attached to a plow mold board:

FIG. 11 is an enlarged end view of the of the third embodiment of this invention attached to a plow mold board:

FIG. 12 is an end view of the rounded cutting edge of the third embodiment of this invention when made of polyurethane or other composite material:

FIG. 13A is a perspective view showing the components of a fourth embodiment of this invention spaced from a plow mold board:

FIG. 13B is an enlarged perspective view of rounded cutting edge of the first embodiment of this invention when made of polyurethane or other composite material:

FIG. 14 is a perspective view showing the fourth embodiment of this invention attached to the front of a traditional cutting edge and a plow mold board:

FIG. 15 is an enlarged end view of the fourth embodiment of this invention attached to the front of a traditional cutting edge and a plow mold board: and FIG. 16 is an end view of the rounded cutting edge of the fourth embodiment of this invention when made of polyurethane or other composite material.

Figure 1A:
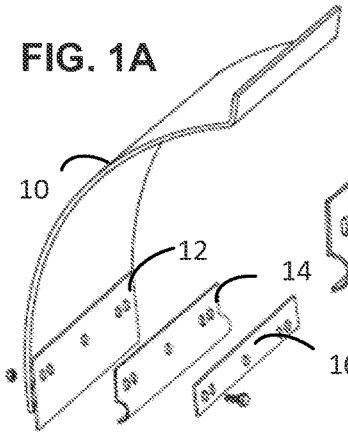
FIG. 1A is a perspective view showing the components of a first embodiment of this invention spaced from a plow mold board.

Returning to FIGS. 1A through 4, what is shown is how a plow blade mold board 10 has a base portion which is normally in contact with the ground. As shown, three superimposed pieces 12, 14, and 16 can be attached using bolts to the base portion of the plow blade mold board 10. Between a traditional cutting edge blade 12, and a reinforcing plate 16 can be mounted a rounded cutting edge 14. Each of these pieces 12, 14, and 16 are different in several substantial ways from the art. As shown with greater detail at FIG. 4, the rounded cutting edge piece 14 has a rounded bottom part and a flat upper part through which holes are drilled. As shown at FIG. 3, the reinforcing plate 16 comes to align over the upper flat portion of the rounded cutting edge piece 14 and bolts secure the piece 14 between the blade 12 and the reinforcing plate 16. As shown at FIG. 4, the thickness of the piece 14 can be the same from the flat upper part to the rounded bottom part.

Figure 7:
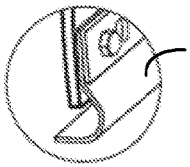
FIG. 7 is an enlarged end view of the of the second embodiment of this invention attached to a plow mold board.
Figure 8:
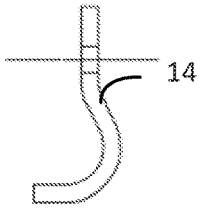
FIG. 8 is an end view of the rounded cutting edge of the second embodiment of this invention.

In the embodiment shown at FIG. 3, the bottom portion of the blade 12 aligns with the bottom curved portion of the piece 14 to reinforce the structure. As shown at FIG. 8, a slightly different piece 14 can be designed to operate without the reinforcement of a traditional cutting edge blade 12. In that case, as shown at FIG. 7, the rounded portion includes on the tip a flat horizontal portion. This longer portion as shown flips under the edge of the blade to protect it against friction.

In the third embodiment shown at FIGS. 9A to 12, instead of having a curved single piece 14 with an upper flat portion for securing to the blade and a rounded lower portion, the bottom portion is a half-moon wear piece. Such a design offers a different profile against wear and tear. As shown, in this embodiment, the use of the blade 12 may not be necessary. The bottom portion of this rounded segment as shown with greater detail at FIG. 11 drops below the board 10 to protect it from wear. Finally, the same way FIGS. 1A to 4 shown a middle plate 14 sandwiched between two pieces 12, 16, the embodiment of FIGS. 13A to 15 shows the same new technology with the blade 12 used to reinforce the curved portion of the piece 14 and protect it from wear.

DETAILED DESCRIPTION OF THE PREFERRED EMBODIMENTS

Figure 1B:
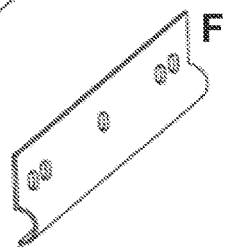
FIG. 1B is an enlarged perspective view of the rounded cutting edge made of steel of the first embodiment of this invention.
Figure 2:
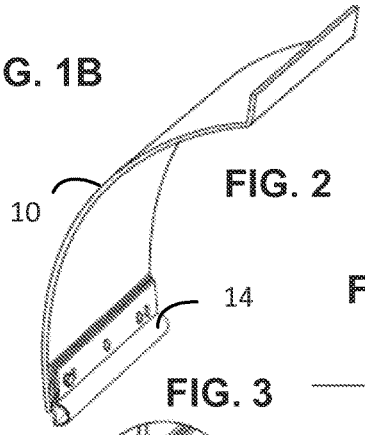
FIG. 2 is a perspective view showing the first embodiment of this invention attached to the face of a traditional cutting edge and a plow mold board.
Figure 3:
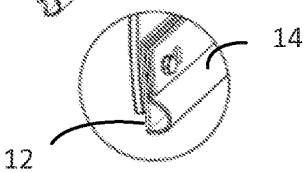
FIG. 3 is an enlarged end view of the of the first embodiment of this invention when attached to the face of a traditional cutting edge and a plow mold board.
Figure 4:
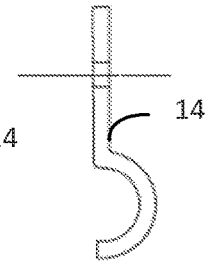
FIG. 4 is an end view of the rounded cutting edge of the first embodiment of this invention.

Referring to FIGS. 1A through 4, a first preferred embodiment of this invention will be described. FIG. 1A shows a customary plow blade mold board 10, and a traditional cutting edge blade 12, both of which are provided with mounting holes of a standard pattern for a particular type of plow mold board. A rounded cutting edge 14 in accordance with this invention is shown spaced from the traditional cutting edge blade 12. The rounded cutting edge has a flat upper section and a lower curved section with a 180 degree radius. A reinforcing plate 16 is shown spaced from the rounded cutting edge 14. Both the rounded cutting edge 14 and the reinforcing plate 16 are provided with mounting holes conforming to the standard pattern of the plow mold board on which they are mounted. As shown in FIG. 2, the rounded cutting edge 14 and the reinforcing plate 16 are secured to the plow blade mold board 10, the traditional cutting edge blade 12, by fastening devices shown as bolts. The bolts, one of which is shown in FIG. 1, pass through holes previously provided in the plow blade mold board 10 for mounting the replaceable traditional cutting edge blade 12. As best shown in the enlarged end view of FIG. 3, the free end of the rounded cutting edge 14 rests even with the lower edge of the traditional cutting edge blade 12. Enlarged perspective and end views of the rounded cutting edge 14 are shown in FIGS. 1B and 4. In this first embodiment of the invention, the rounded cutting edge 14 and the reinforcing plate 18 are formed of a wear resistant steel.

Figure 5A:
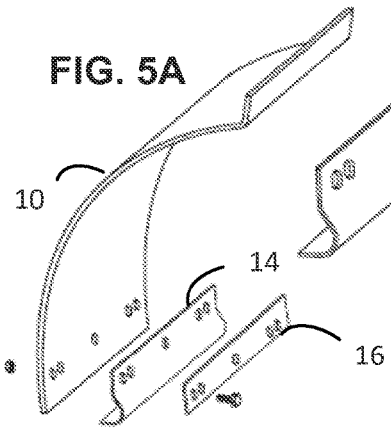
FIG. 5A is a perspective view showing the components of a second embodiment of this invention spaced from a plow mold board.
Figure 5B:
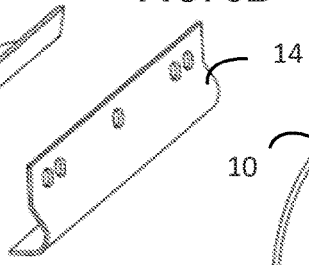
FIG. 5B is an enlarged perspective view of rounded cutting edge of the first embodiment of this invention.
Figure 6:
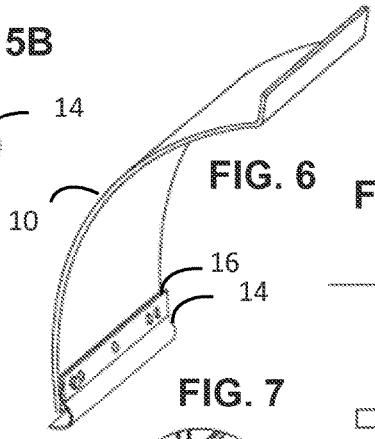
FIG. 6 is a perspective view showing the second embodiment of this invention attached to a plow mold board.

Referring to FIGS. 5A through 8, a second preferred embodiment of this invention will be described. FIG. 5A shows a customary plow blade mold board 10, with the traditional cutting edge blade removed. A rounded cutting edge 14 in accordance with this invention is shown spaced from the plow mold board 10. A reinforcing plate 16 is shown spaced from the rounded cutting edge 14. As shown in FIG. 6, the rounded cutting edge 14 and the reinforcing plate 16 are secured to the plow blade mold board 10, by fastening devices shown as bolts. The bolts pass through holes previously provided in the plow blade mold board 10 for mounting the traditional replaceable cutting edge blade 12. As best shown in the enlarged end view of FIG. 7, the free end of the rounded cutting edge 14 extends under the lower edge of the plow mold board 10. Enlarged perspective and end views of the rounded cutting edge 14 are shown in FIGS. 5B and 8. In this second embodiment of the invention, the rounded cutting edge 14 and the reinforcing plate 16 are formed of a wear resistant steel. Comparing FIGS. 4 and 8, in the second embodiment, the lower, surface engaging end of the rounded cutting edge 14 has a horizontal extension which extends under the lower edge of the plow mold board 10.

Referring to FIGS. 9A through 12, a second preferred embodiment of this invention will be described. FIG. 9A shows a customary plow blade mold board 10, with the traditional cutting edge blade removed. A rounded cutting edge 14 in accordance with this invention is shown spaced from the plow mold board 10. A reinforcing plate 16 is shown spaced from the rounded cutting edge 14. As shown in FIG. 14, the rounded cutting edge 14 and the reinforcing plate 16 are secured to the plow blade mold board 10, by fastening devices shown as bolts. The bolts pass through holes previously provided in the plow blade mold board 10 for mounting the traditional replaceable cutting edge blade 12. As best shown in the enlarged end view of FIG. 11, the free end of the rounded cutting edge 14 extends below the lower edge of the plow mold board 10. Enlarged perspective and end views of the rounded cutting edge 14 are shown in FIGS. 9B and 12. In this second embodiment of the invention, the rounded cutting edge 14 is formed of a solid composite material.

Referring to FIGS. 13A through 16, a fourth preferred embodiment of this invention will be described. FIG. 13A shows a customary plow blade mold board 10, and a traditional cutting edge blade 12. A rounded cutting edge 14 in accordance with this invention is shown spaced from the traditional cutting edge blade 12. A reinforcing plate 16 is shown spaced from the rounded cutting edge 14. As shown in FIG. 14, the rounded cutting edge 14 and the reinforcing plate 16 are secured to the plow blade mold board 10, the traditional cutting edge blade 12, by fastening devices shown as bolts. The bolts pass through holes previously provided in the plow blade mold board 10 for mounting the replaceable traditional cutting edge blade 12. As best shown in the enlarged end view of FIG. 15, the lower end of the rounded cutting edge 14 is aligned with the lower edge of the traditional cutting edge blade 12. Enlarged perspective and end views of the rounded cutting edge 14 are shown in FIGS. 13B and 16. In this fourth embodiment of the invention, the rounded cutting edge 14 is formed of a solid composite material. Presuming the traditional cutting edge blade 12 to be more wear resistant than the composite rounded cutting edge 14, the wear on the surface engaging portion of the composite rounded cutting edge 14 will be limited to the wear on the lower edge of the traditional cutting edge blade 12.

While several embodiments of this invention have been shown, it should be apparent to those skilled in the art that what has been shown and described are considered at present to be preferred embodiments of this invention. In accordance with the Patent Statutes, changes may be made in the cutting edge attachment for snow plows of this invention without actually departing from the true spirit and scope of this invention. The appended claims are intended to cover all such changes and modifications which fall in the true spirit and scope of this invention.

The invention claimed is:

1. A snow plow blade attachment and mounting for use with an existing plow blade mold board with a set of holes, comprising:

a traditional cutting blade with a hole pattern and with a bottom part having a lower edge for engaging a ground;

a reinforcing plate with the hole pattern;

and a rounded cutting edge snow blade attachment having a first upper vertical flat thin section of a thickness with pre-drilled holes that match the hole pattern to receive the reinforcing plate on one side and the traditional cutting blade on the other side to secure the blade attachment to the traditional cutting blade, further including integral and adjacent to the first upper vertical flat thin section a second lower thin section of the first thickness separated from the first upper vertical flat thin section by a horizontal bend of approximately 30 to 45 degrees from the vertical and wherein the second lower thin section includes a primary curved section forming a rounded portion that protrudes forward of the first upper vertical flat thin section and bends downward to pass below the lower edge of the bottom part of the traditional cutting blade in a secondary flat and horizontal section.

2. The snow plow blade attachment and mounting of claim 1, wherein the rounded cutting edge snow plow blade attachment is formed from a material selected from the group consisting of carbon steel, carbide or a combination thereof.

3. The snow plow blade attachment and mounting of claim 1, wherein the reinforcing plate overlays the upper flat section on the side opposite the plow blade mold board.

* * * * *